US010269288B2

(12) United States Patent
Kim et al.

(10) Patent No.: US 10,269,288 B2
(45) Date of Patent: Apr. 23, 2019

(54) DISPLAY DEVICES AND DISPLAY SYSTEMS HAVING THE SAME

(71) Applicant: SAMSUNG ELECTRONICS CO., LTD., Suwon-si (KR)

(72) Inventors: Jeong-Pyo Kim, Seoul (KR); Jin-Hong Hwang, Gwacheon-si (KR); Ki-Ho Kong, Suwon-si (KR); Yang-Hyo Kim, Suwon-si (KR); Eui-Hyuk Jeong, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 108 days.

(21) Appl. No.: 15/362,931

(22) Filed: Nov. 29, 2016

(65) Prior Publication Data

US 2017/0169756 A1 Jun. 15, 2017

(30) Foreign Application Priority Data

Dec. 15, 2015 (KR) ..... 10-2015-0179116

(51) Int. Cl.
*G09G 3/20* (2006.01)

(52) U.S. Cl.
CPC ... *G09G 3/2092* (2013.01); *G09G 2310/0224* (2013.01); *G09G 2310/0291* (2013.01); *G09G 2330/00* (2013.01)

(58) Field of Classification Search
CPC ..... G09G 3/2092; G09G 2310/0224; G09G 2310/0235; G09G 2310/0291; G09G 2330/00; G09G 5/18; G09G 2352/00; G02B 2027/0132; G02B 2027/0178
See application file for complete search history.

(56) References Cited

U.S. PATENT DOCUMENTS 5,040,874 A * 8/1991 Fukuda ..... G09G 3/3688 345/87
6,239,779 B1 * 5/2001 Furuya ..... G09G 3/3648 345/87
6,320,568 B1 * 11/2001 Zavracky ..... A61B 3/113 257/E21.614

(Continued)

FOREIGN PATENT DOCUMENTS

KR 10-2012-0063213 A 6/2012
KR 10-2012-0073793 A 7/2012

(Continued)

*Primary Examiner* — Tom V Sheng
(74) *Attorney, Agent, or Firm* — Sughrue Mion, PLLC

(57) ABSTRACT

A display device includes an image processor configured to invert a switch signal at a change of frames, and output, based on the switch signal, one among odd column pixel data and even column pixel data among first through (2M)-th column pixel data included in a frame data, as a half frame data, a display panel including first through M-th odd column pixels coupled to first through M-th odd column lines, respectively, and first through M-th even column pixels coupled to first through M-th even column lines, respectively, and a driving circuit including first through M-th driving units including a K-th driving unit configured to drive, based on the switch signal, one among K-th odd column pixels through a K-th odd column line and K-th even column pixels through a K-th even column line, using a K-th column pixel data included in the half frame data.

20 Claims, 14 Drawing Sheets

(56) References Cited

U.S. PATENT DOCUMENTS

| | | | | |
|---|---|---|---|---|
| 8,120,703 | B2 | 2/2012 | Adams | |
| 9,117,386 | B2 | 8/2015 | Lim et al. | |
| 2002/0089485 | A1* | 7/2002 | Youn | G09G 3/3614 345/99 |
| 2006/0055781 | A1 | 3/2006 | Yi et al. | |
| 2006/0066555 | A1* | 3/2006 | Miyagawa | G09G 3/2007 345/100 |
| 2007/0097056 | A1* | 5/2007 | Tseng | G09G 3/3614 345/96 |
| 2008/0002109 | A1* | 1/2008 | Ong | G02F 1/133707 349/98 |
| 2012/0105494 | A1* | 5/2012 | Lee | G09G 3/3614 345/690 |
| 2012/0127143 | A1* | 5/2012 | Gondo | G09G 3/3648 345/208 |
| 2014/0009458 | A1* | 1/2014 | Nam | G09G 3/3696 345/212 |
| 2015/0015472 | A1* | 1/2015 | Nakayama | G09G 3/3688 345/98 |
| 2015/0187334 | A1 | 7/2015 | Oh et al. | |

FOREIGN PATENT DOCUMENTS

| | | | |
|---|---|---|---|
| KR | 10-2013-0071206 | A | 6/2013 |
| KR | 10-1408250 | B1 | 6/2014 |
| KR | 10-2014-0082488 | A | 7/2014 |
| KR | 10-2015-0073482 | A | 7/2015 |
| KR | 10-2015-0077169 | A | 7/2015 |

* cited by examiner

200

DISPLAY DEVICES AND DISPLAY SYSTEMS HAVING THE SAME

CROSS-REFERENCE TO RELATED APPLICATION(S)

This application claims priority from Korean Patent Application No. 10-2015-0179116, filed on Dec. 15, 2015, in the Korean Intellectual Property Office, the disclosure of which is incorporated herein by reference in its entirety.

BACKGROUND

1. Field

Apparatuses consistent with example embodiments relate to a display device, and more particularly, to a display device that drives a display panel using only a half of a frame data and a display system including the display device.

2. Description of the Related Art

As a size and a resolution of a display panel included in a display device increases, power consumption of a display device also increases. Power consumption of a display device is divided into a static power consumption, which is consumed by a driving circuit, and a dynamic power consumption, which is consumed by a display panel to charge and discharge pixels included in the display panel.

The dynamic power consumption varies based on a size of a frame data. Therefore, if a size of a frame data is large, the dynamic power consumption increases.

SUMMARY

According to example embodiments, a display device includes an image processor configured to invert a logic level of a switch signal at a change of frames, and output, based on the logic level of the switch signal, one among odd column pixel data and even column pixel data among first through (2M)-th column pixel data included in a frame data, as a half frame data, M being a positive integer. The display device further includes a display panel including first through M-th odd column pixels coupled to first through M-th odd column lines, respectively, and first through M-th even column pixels coupled to first through M-th even column lines, respectively. The display device further includes a driving circuit including first through M-th driving units including a K-th driving unit, the K-th driving unit being configured to drive, based on the logic level of the switch signal, one among K-th odd column pixels, among the first through M-th odd column pixels, through a K-th odd column line, among the first through M-th odd column lines, using a K-th column pixel data included in the half frame data, and K-th even column pixels, among the first through M-th even column pixels, through a K-th even column line, among the first through M-th even column lines, using the K-th column pixel data included in the half frame data, K being a positive integer less than or equal to M.

According to example embodiments, a display device includes an image processor configured to invert a logic level of a switch signal at a change of frames, and output, based on the logic level of the switch signal, one among (a, b)-th pixel data and (c, d)-th pixel data among (1, 1)-th through (M, N)-th pixel data included in a frame data, as a half frame data, M and N being positive integers, a and c being positive integers less than or equal to M, b and d being positive integers less than or equal to N, a+b being an even number, and c+d being an odd number. The display device further includes a display panel including (1, 1)-th to (M, N)-th pixels coupled to respective column lines and respective row lines in a matrix form, and a driver configured to drive, based on the logic level of the switch signal, one among (a, b)-th pixels, among the (1, 1)-th to (M, N)-th pixels, through the respective column lines and the respective row lines, using the (a, b)-th pixel data included in the half frame data, and (c, d)-th pixels, among the (1, 1)-th to (M, N)-th pixels, through the respective column lines and the respective row lines, using the (c, d)-th pixel data included in the half frame data.

According to example embodiments, a display system includes a central processing unit configured to generate a frame data, and a display device configured to invert a logic level of a switch signal at a change of frames, select, based on the logic level of the switch signal, one among odd column pixel data and even column pixel data among first through (2M)-th column pixel data included in the frame data, as a half frame data, M being a positive integer, and display the half frame data during a frame period.

According to example embodiments, a display device includes an image processor configured to change a switch signal at a change of frames, output odd column pixel data based on a first logic level of the switch signal, and output even column pixel data based on a second logic level of the switch signal. The display device further includes a display panel including odd column pixels coupled to respective odd column lines, and even column pixels coupled to respective even column lines, and a driving circuit including driving units configured to drive, based on the first logic level of the switch signal, the respective odd column pixels through the respective odd column lines, using the odd column pixel data, and drive, based on the second logic level of the switch signal, the respective even column pixels through the respective even column lines, using the even column pixel data.

DETAILED DESCRIPTION OF THE EXAMPLE EMBODIMENTS

Figure 1:
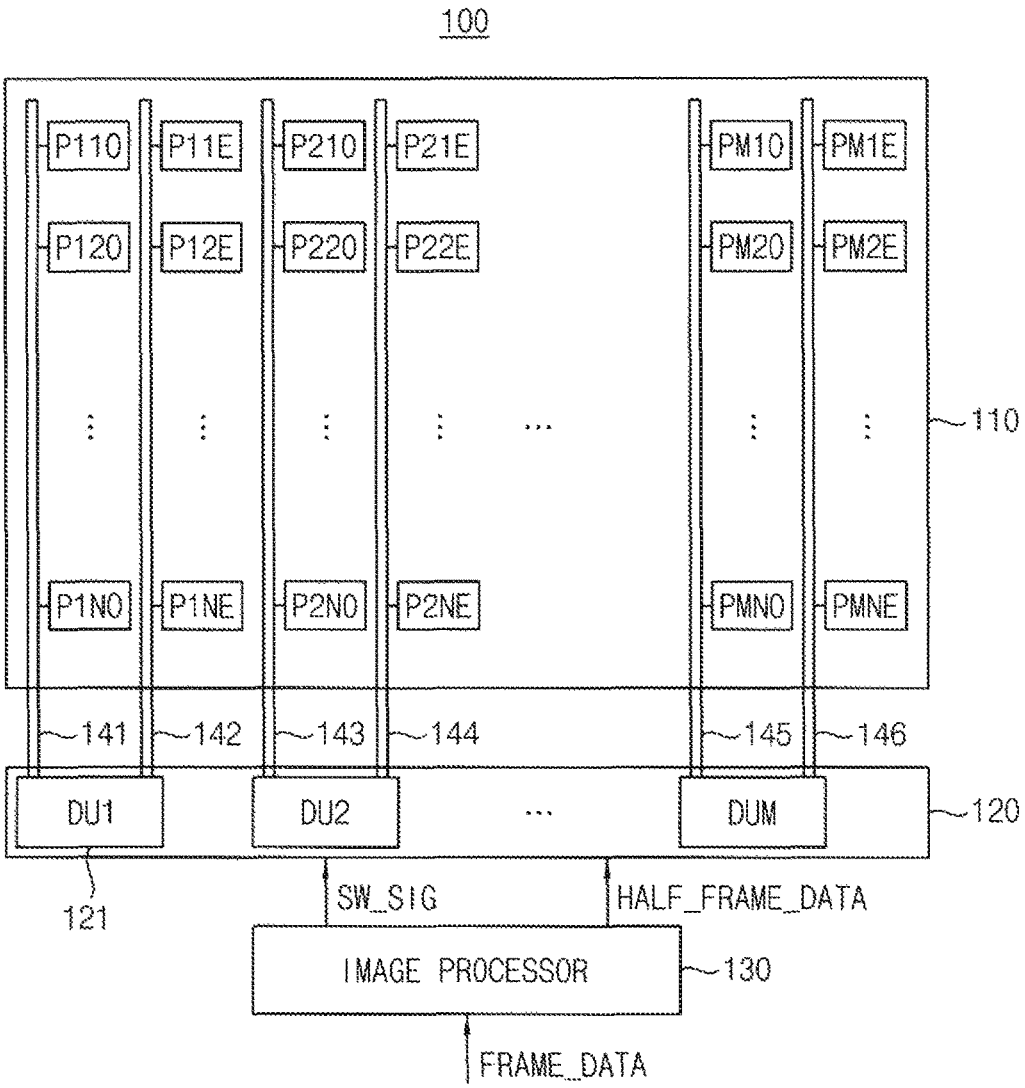
FIG. 1 is a block diagram illustrating a display device according to example embodiments.

FIG. 1 is a block diagram illustrating a display device according to example embodiments.

Referring to FIG. 1, a display device 100 includes a display panel 110, a driving circuit 120, and an image processor 130.

The driving circuit 120 includes first through M-th driving units DU1~DUM. Here, M represents a positive integer.

The display panel 110 may include first through M-th odd column pixels coupled to first through M-th odd column lines, respectively, and first through M-th even column pixels coupled to first through M-th even column lines, respectively. For example, the display panel 110 includes first odd column pixels P11O, P12O, . . . , P1NO coupled to a first odd column line 141, second odd column pixels P21O, P22O, . . . , P2NO coupled to a second odd column line 143, and M-th odd column pixels PM1O, PM2O, . . . , PMNO coupled to an M-th odd column line 145. In addition, the display panel 110 includes a first even column pixels P11E, P12E, . . . , P1NE coupled to a first even column line 142, a second even column pixels P21E, P22E, . . . , P2NE coupled to a second even column line 144, and an M-th even column pixels PM1E, PM2E, . . . , PMNE coupled to an M-th even column line 146.

The K-th even column line may be between the K-th odd column line and the (K+1)-th odd column line. That is, the K-th odd column line is adjacent to the K-th even column line, and the K-th even column line is adjacent to the (K+1)-th odd column line. Here, K represents a positive integer less than or equal to M. For example, the first odd column line 141 is adjacent to the first even column line 142, the first even column line 142 is adjacent to the second odd column line 143, the second odd column line 143 is adjacent to the second even column line 144, and the M-th odd column line 145 is adjacent to the M-th even column line 146.

The image processor 130 generates a switch signal SW_SIG. The image processor 130 may invert a logic level of the switch signal SW_SIG at a change of frames. The image processor 130 may output one among odd column pixel data and even column pixel data among first through (2M)-th column pixel data included in a frame data FRAME_DATA as a half frame data HALF_FRAME_DATA based on the logic level of the switch signal SW_SIG. The odd column pixel data and the even column pixel data will be described later with reference to FIGS. 2 and 3.

Based on the logic level of the switch signal SW_SIG, the K-th driving unit DUK may drive the K-th odd column pixels through the K-th odd column line using a K-th column pixel data included in the half frame data HALF_FRAME_DATA, or drive the K-th even column pixels through the K-th even column line using the K-th column pixel data included in the half frame data HALF_FRAME_DATA.

For example, a first driving unit DU1 121 may drive the first odd column pixels P11O, P12O, . . . , P1NO through the first odd column line 141 using a first column pixel data included in the half frame data HALF_FRAME_DATA, or drive the first even column pixels P11E, P12E, . . . , P1NE through the first even column line 142 using the first column pixel data included in the half frame data HALF_FRAME_DATA, based on the logic level of the switch signal SW_SIG. The second driving unit DU2 may drive the second odd column pixels P21O, P22O, . . . , P2NO through the second odd column line 143 using a second column pixel data included in the half frame data HALF_FRAME_DATA, or drive the second even column pixels P21E, P22E, . . . , P2NE through the second even column line 144 using the second column pixel data included in the half frame data HALF_FRAME_DATA, based on the logic level of the switch signal SW_SIG. The M-th driving unit DUM may drive the M-th odd column pixels PM1O, PM2O, . . . , PMNO through the M-th odd column line 145 using a M-th column pixel data included in the half frame data HALF_FRAME_DATA, or drive the M-th even column pixels PM1E, PM2E, . . . , PMNE through the M-th even column line 146 using the M-th column pixel data included in the half frame data HALF_FRAME_DATA, based on the logic level of the switch signal SW_SIG.

Figure 2:
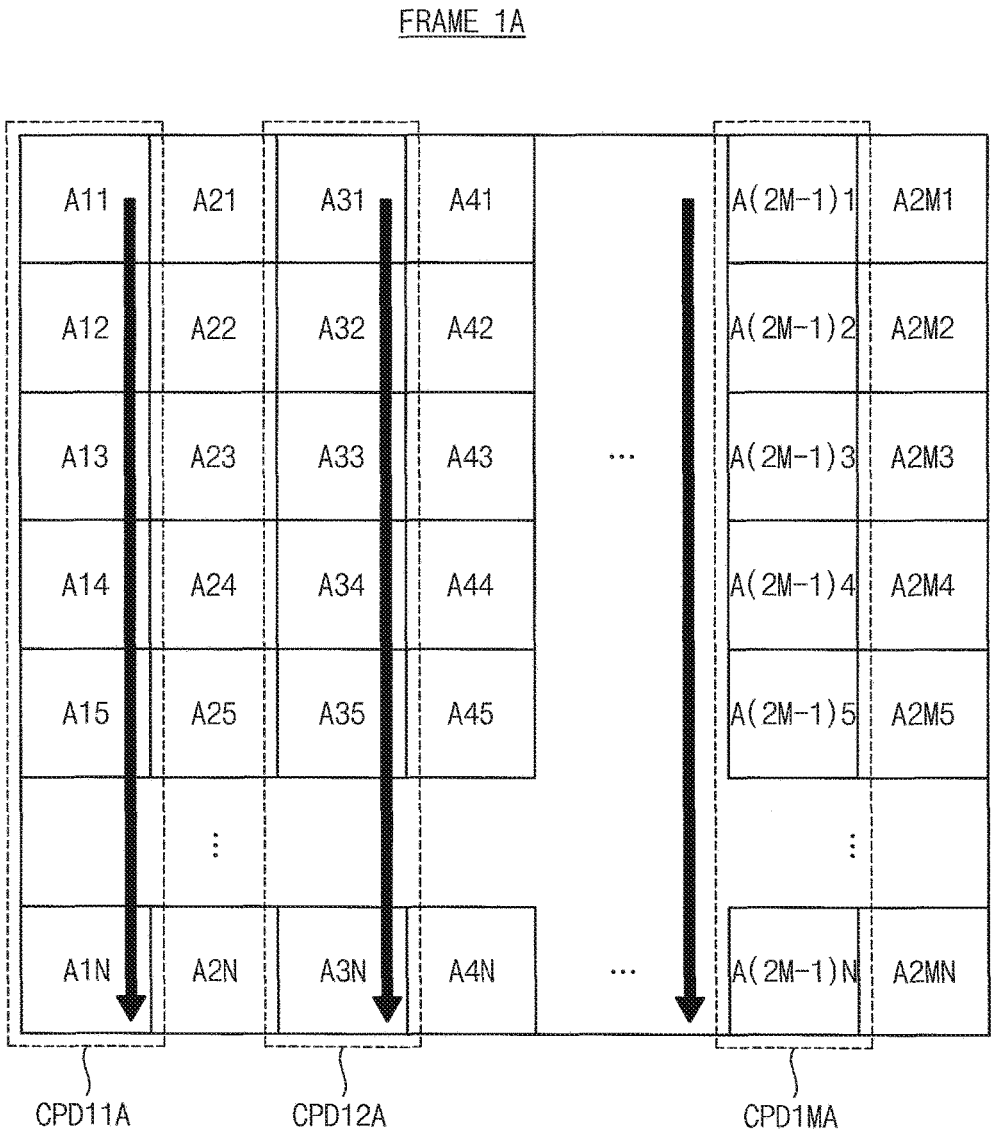
FIGS. 2 and 3 are diagrams illustrating a frame data provided to the display device of FIG. 1.
Figure 3:
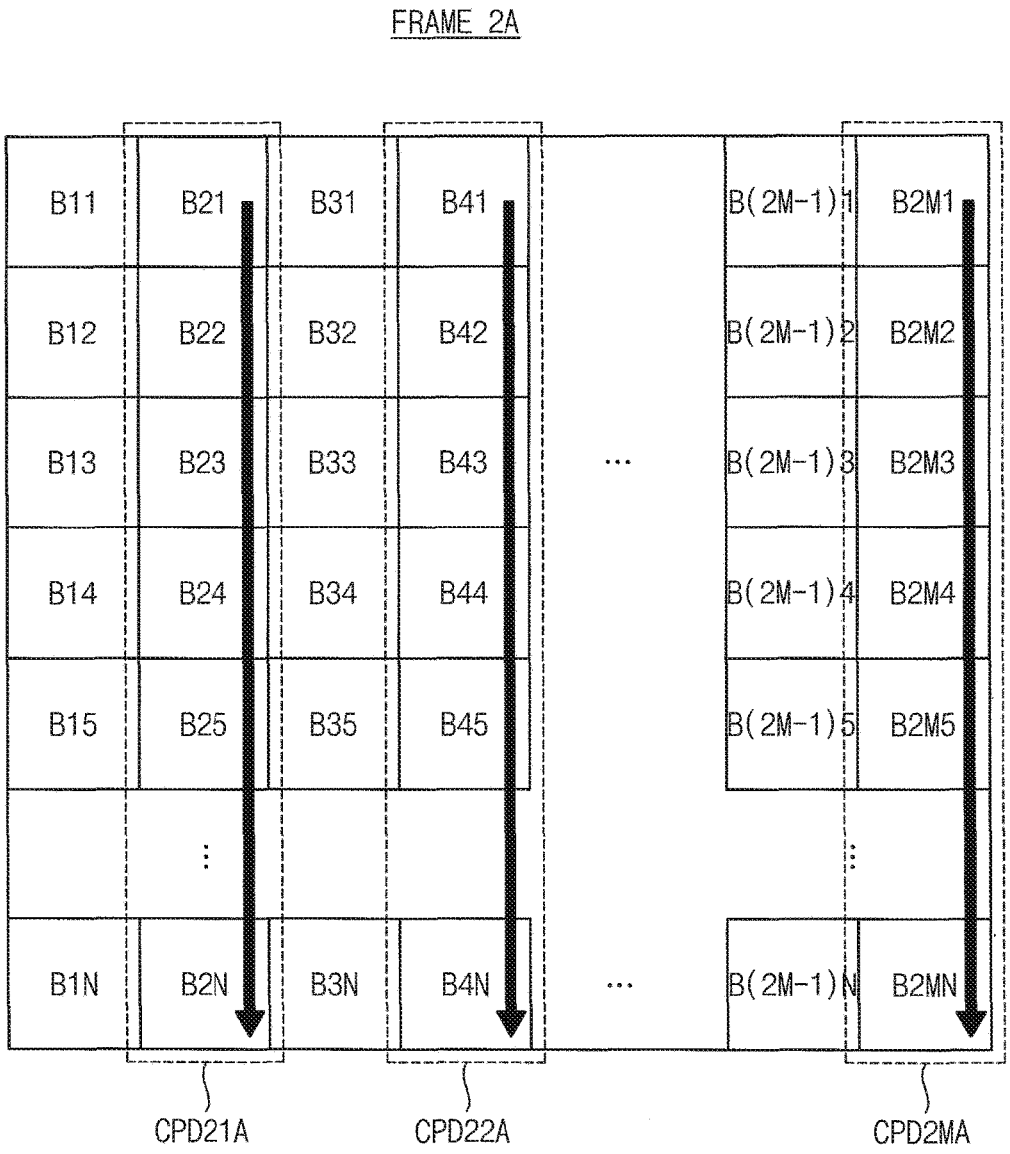

FIGS. 2 and 3 are diagrams illustrating a frame data provided to the display device of FIG. 1.

After a first frame data FRAME 1A of FIG. 2 is provided to the display device 100 of FIG. 1 as the frame data FRAME_DATA, a second frame data FRAME 2A of FIG. 3 may be provided to the display device 100 of FIG. 1 as the frame data FRAME_DATA.

In example embodiments, as illustrated in FIG. 2, when the switch signal SW_SIG is activated, the image processor 130 may output the odd column pixel data CPD11A (A11~A1N), CPD12A(A31~A3N), . . . , CPD1MA(A(2M-1)1~A(2M-1)N) among the first frame data FRAME 1A as the half frame data HALF_FRAME_DATA.

In this case, the K-th driving unit DUK may drive the K-th odd column pixels using the K-th column pixel data included in the half frame data HALF_FRAME_DATA. For example, the first driving unit DU1 may drive the first odd column pixels P11O, P12O, . . . , P1NO using the first column pixel data CPD11A(A11~A1N) included in the half frame data HALF_FRAME_DATA, the second driving unit DU2 may drive the second odd column pixels P21O, P22O, . . . , P2NO using the second column pixel data CPD12A(A31~A3N) included in the half frame data HALF_ FRAME_DATA, and the M-th driving unit DUM may drive the M-th odd column pixels PM1O, PM2O, . . . , PMNO using the M-th column pixel data CPD1MA(A(2M-1)1~A(2M-1)N) included in the half frame data HALF_FRAME_DATA.

In this case, the K-th even column pixels may maintain a previous status without being driven by the K-th driving unit DUK. For example, the first even column pixels P11E, P12E, . . . , P1NE, the second even column pixels P21E, P22E, . . . , P2NE, and the M-th even column pixels PM1E, PM2E, . . . , PMNE may maintain a previous status without being driven by the first driving unit DU1, the second driving unit DU2, and the M-th driving unit DUM, respectively.

In example embodiments, as illustrated in FIG. 3, when the switch signal SW_SIG is deactivated, the image processor 130 may output the even column pixel data CPD21A (B21~B2N), CPD22A(B41~B4N), . . . , CPD2MA (B2M1~B2MN) among the first frame data FRAME 2A as the half frame data HALF_FRAME_DATA.

In this case, the K-th driving unit DUK may drive the K-th even column pixels using the K-th column pixel data included in the half frame data HALF_FRAME_DATA. For example, the first driving unit DU1 may drive the first even column pixels P11E, P12E, . . . , P1NE using the first column pixel data CPD21A(B21~B2N) included in the half frame data HALF_FRAME_DATA, the second driving unit DU2 may drive the second even column pixels P21E, P22E, . . . , P2NE using the second column pixel data CPD22A(B41~B4N) included in the half frame data HALF_FRAME_DATA, and the M-th driving unit DUM may drive the M-th even column pixels PM1E, PM2E, . . . , PMNE using the M-th column pixel data CPD2MA(B2M1~B2MN) included in the half frame data HALF_FRAME_DATA.

In this case, the K-th odd column pixels may maintain a previous status without being driven by the K-th driving unit DUK. For example, the first odd column pixels P11O, P12O, . . . , P1NO, the second odd column pixels P21O, P22O, . . . , P2NO, and the M-th odd column pixels PM1O, PM2O, . . . , PMNO may maintain a previous status without being driven by the first driving unit DU1, the second driving unit DU2, and the M-th driving unit DUM, respectively.

Figure 4:
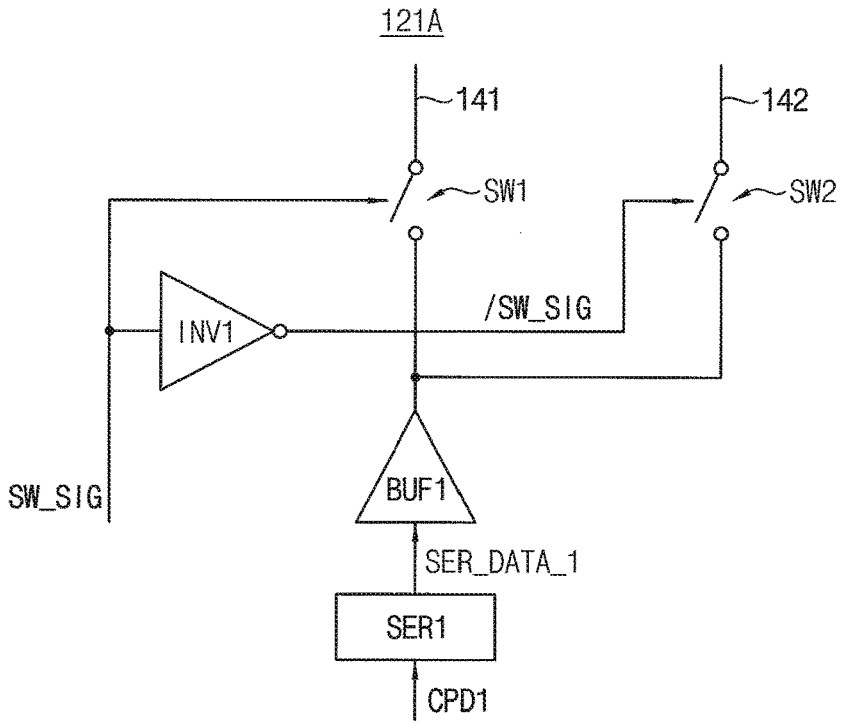
FIGS. 4 and 5 are circuit diagrams illustrating examples of a first driving unit included in the display device of FIG. 1.
Figure 5:
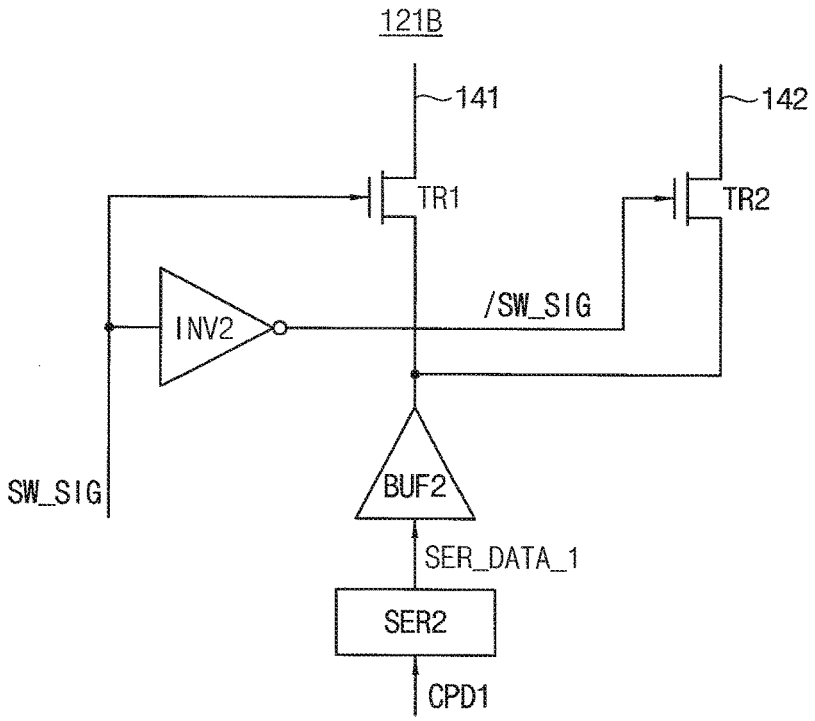

FIGS. 4 and 5 are circuit diagrams illustrating examples of a first driving unit included in the display device of FIG. 1.

Each of the second through M-th driving units DU2~DUM included in the display device 100 of FIG. 1 may have the same structure as first driving units 121A and 121B of FIGS. 4 and 5.

Referring to FIG. 4, the first driving unit 121A includes a first serializer SER1, a first inverter INV1, a first buffer BUF1, a first switch SW1, and a second switch SW2.

The first serializer SER1 receives the first column pixel data CPD1 included in the half frame data HALF_FRAME_DATA from the image processor 130, and serializes the first column pixel data CPD1 to generate a first serial data SER_DATA_1. For example, the first column pixel data CPD1 may correspond to the first column pixel data CPD11A(A11~A1N) in the case of FIG. 2, and correspond to the first column pixel data CPD21A(B21~B2N) in the case of FIG. 3.

The first inverter INV1 receives the switch signal SW_SIG, and inverts the switch signal SW_SIG to generate an inverted version of the switch signal/SW_SIG.

The first buffer BUF1 receives the first serial data SER_DATA_1, and outputs an amplified version of the first serial data SER_DATA_1.

The first switch SW1 is coupled between an output electrode of the first buffer BUF1 and a first odd column line 141. The first switch SW1 may be turned on in response to the switch signal SW_SIG.

The second switch SW2 is coupled between the output electrode of the first buffer BUF1 and a first even column line 142. The second switch SW2 may be turned on in response to the inverted version of the switch signal/SW_SIG.

When the switch signal SW_SIG is activated, the first switch SW1 may be turned on and the second switch SW2 may be turned off. Therefore, the first buffer BUF1 may consecutively drive the first odd column pixels P11O, P12O, . . . , P1NO coupled to the first odd column line 141 using the amplified version of the first serial data SER_DATA_1.

When the switch signal SW_SIG is deactivated, the first switch SW1 may be turned off and the second switch SW2 may be turned on. Therefore, the first buffer BUF1 may consecutively drive the first even column pixels P11E, P12E, . . . , P1NE coupled to the first even column line 142 using the amplified version of the first serial data SER_DATA_1.

Referring to FIG. 5, the first driving unit 121B includes a second serializer SER2, a second inverter INV2, a second buffer BUF2, a first n-type metal oxide semiconductor (NMOS) transistor TR1, and a second NMOS transistor TR2.

The second serializer SER2 receives the first column pixel data CPD1 included in the half frame data HALF_FRAME_DATA from the image processor 130, and serializes the first column pixel data CPD1 to generate a first serial data SER_DATA_1. For example, the first column pixel data CPD1 may correspond to the first column pixel data CPD11A(A11~A1N) in the case of FIG. 2, and correspond to the first column pixel data CPD21A(B21~B2N) in the case of FIG. 3.

The second inverter INV2 receives the switch signal SW_SIG, and inverts the switch signal SW_SIG to generate an inverted version of the switch signal /SW_SIG.

The second buffer BUF2 receives the first serial data SER_DATA_1, and outputs an amplified version of the first serial data SER_DATA_1.

The first NMOS transistor TR1 is coupled between an output electrode of the second buffer BUF2 and the first odd column line 141. A gate of the first NMOS transistor TR1 receives the switch signal SW_SIG.

The second NMOS transistor TR2 is coupled between the output electrode of the second buffer BUF2 and the first even column line 142. A gate of the second NMOS transistor TR2 receives the inverted version of the switch signal/SW_SIG.

Although a structure of the first through M-th driving units DU1~DUM is described above with reference to FIGS. 4 and 5, example embodiments are not limited thereto. According to example embodiments, the first through M-th driving units DU1~DUM may be implemented with other structures.

Figure 6:
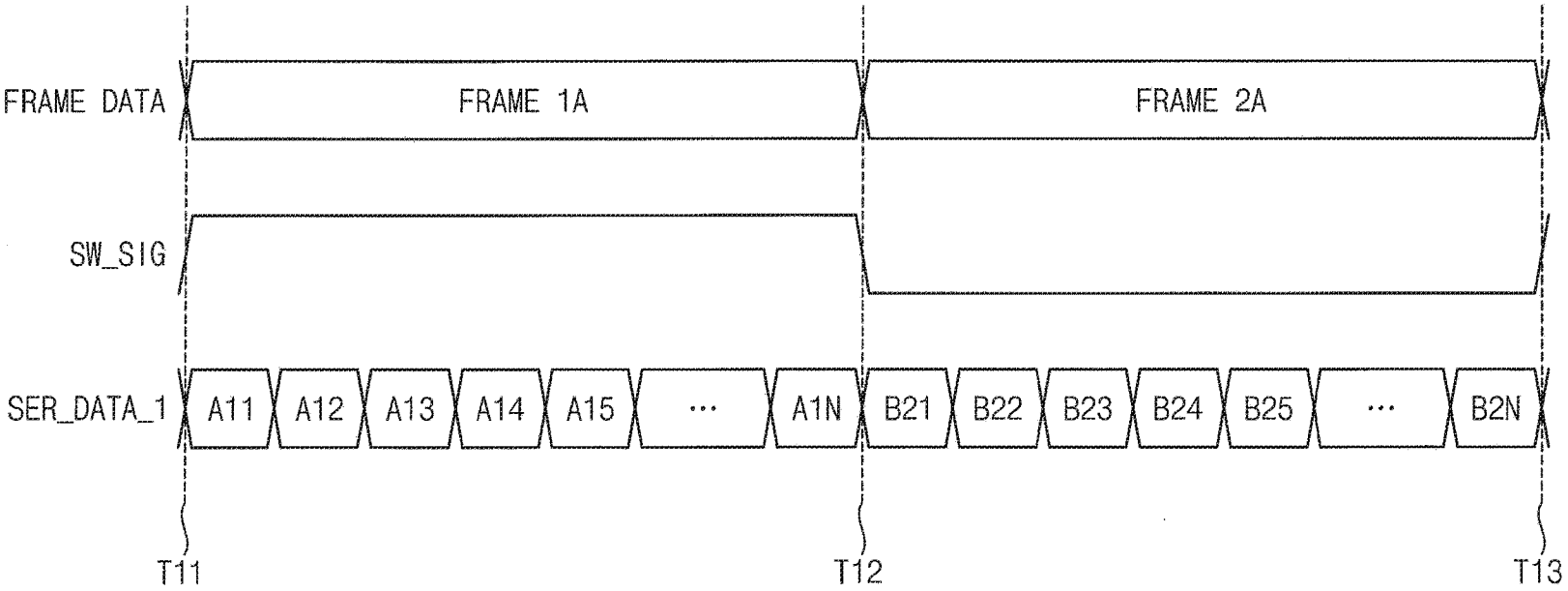
FIG. 6 is a timing diagram illustrating an operation of the first driving unit of FIG. 1.

FIG. 6 is a timing diagram illustrating an operation of the first driving unit of FIG. 1.

Referring to FIG. 6, a new frame period starts at a first time T11, and the first frame data FRAME 1A of FIG. 2 may be provided to the image processor 130 as the frame data FRAME_DATA at the first time T11. Therefore, the image processor 130 may activate the switch signal SW_SIG from the first time T11 to a second time T12. During the frame period from the first time T11 to the second time T12, the first driving unit DU1 may consecutively drive the first odd column pixels P11O P12O . . . , P1NO coupled to the first odd column line 141 using the first serial data SER_DATA_1 including the first column pixel data CPD11A(A11~A1N) of FIG. 2. During the frame period from the first time T11 to the second time T12, the first even column pixels P11E, P12E, . . . , P1NE, the second even column pixels P21E, P22E, . . . , P2NE, and the M-th even column pixels PM1E, PM2E, . . . , PMNE may maintain a previous status without being driven by the first driving unit DU1, the second driving unit DU2, and the M-th driving unit DUM, respectively.

A next frame period starts at the second time T12, and the second frame data FRAME 2A of FIG. 3 may be provided to the image processor 130 as the frame data FRAME_DATA at the second time T12. Therefore, the image processor 130 may deactivate the switch signal SW_SIG from the second time T12 to a third time T13. During the frame period from the second time T12 to the third time T13, the first driving unit DU1 may consecutively drive the first even column pixels P11E, P12E, . . . , P1NE coupled to the first even column line 142 using the first serial data SER_DATA_1 including the first column pixel data CPD21A(B21~B2N) of FIG. 3. During the frame period from the second time T12 to the third time T13, the first odd column pixels P11O, P12O, . . . , P1NO, the second odd column pixels P21O, P22O, . . . , P2NO, and the M-th odd column pixels PM1O, PM2O, . . . , PMNO may maintain a previous status without being driven by the first driving unit DU1, the second driving unit DU2, and the M-th driving unit DUM, respectively.

Figure 7:
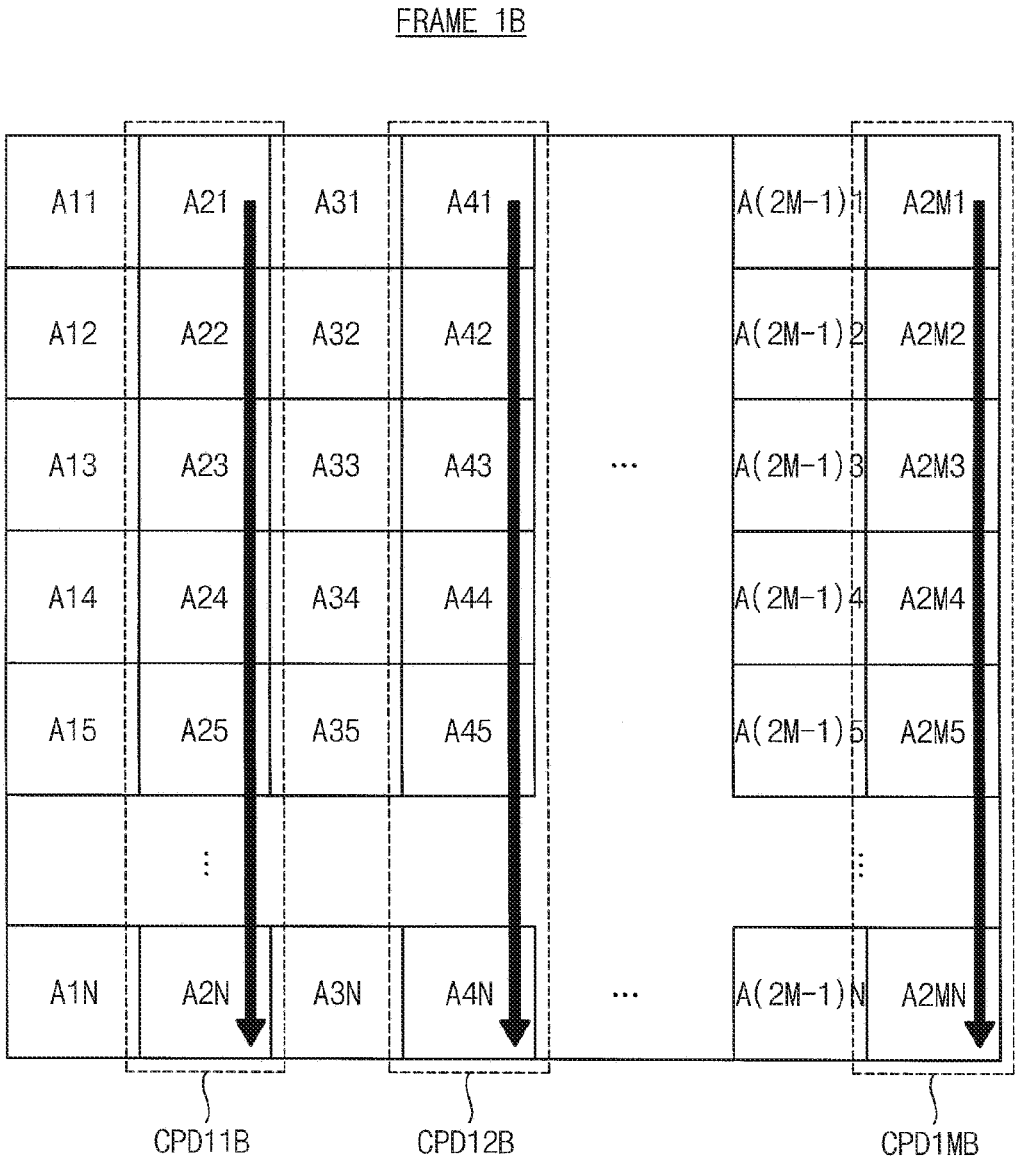
FIGS. 7 and 8 are diagrams illustrating a frame data provided to the display device of FIG. 1.
Figure 8:
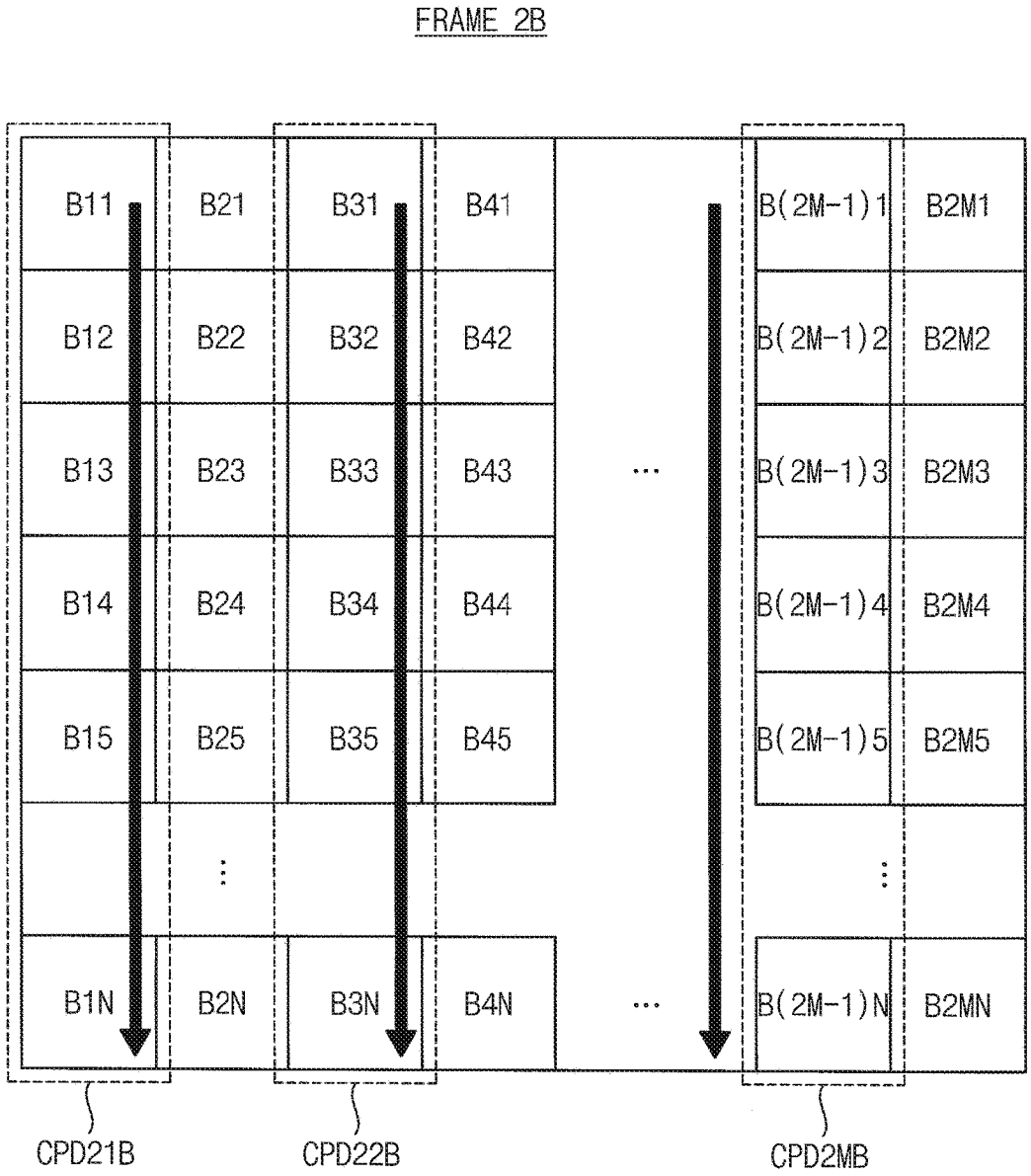

FIGS. 7 and 8 are diagrams illustrating a frame data provided to the display device of FIG. 1.

After a first frame data FRAME 1B of FIG. 7 is provided to the display device 100 of FIG. 1 as the frame data FRAME_DATA, a second frame data FRAME 2B of FIG. 8 may be provided to the display device 100 of FIG. 1 as the frame data FRAME_DATA.

In example embodiments, as illustrated in FIG. 7, when the switch signal SW_SIG is activated, the image processor 130 may output the even column pixel data CPD11B (A21~A2N), CPD12B(A41~A4N), . . . , CPD1MB (A2M1~A2MN) among the first frame data FRAME 1B as the half frame data HALF_FRAME_DATA.

In this case, the K-th driving unit DUK may drive the K-th even column pixels using the K-th column pixel data included in the half frame data HALF_FRAME_DATA. For example, the first driving unit DU1 may drive the first even column pixels P11E, P12E, . . . , P1NE using the first column pixel data CPD11B(A21~A2N) included in the half frame data HALF_FRAME_DATA, the second driving unit DU2 may drive the second even column pixels P21E, P22E, . . . , P2NE using the second column pixel data CPD12B(A41~A4N) included in the half frame data HALF_FRAME_DATA, and the M-th driving unit DUM may drive the M-th even column pixels PM1E, PM2E, . . . , PMNE using the M-th column pixel data CPD1MB(A2M1~A2MN) included in the half frame data HALF_FRAME_DATA.

In this case, the K-th odd column pixels may maintain a previous status without being driven by the K-th driving unit DUK. For example, the first odd column pixels P11O, P12O, . . . , P1NO, the second odd column pixels P21O, P22O, . . . , P2NO, and the M-th odd column pixels PM1O, PM2O, . . . , PMNO may maintain a previous status without being driven by the first driving unit DU1, the second driving unit DU2, and the M-th driving unit DUM, respectively.

In example embodiments, as illustrated in FIG. 8, when the switch signal SW_SIG is deactivated, the image processor 130 may output the odd column pixel data CPD21B (B11~B1N), CPD22B(B31~B3N), . . . , CPD2MB(B(2M-1)1~B(2M-1)N) among the second frame data FRAME 2B as the half frame data HALF_FRAME_DATA.

In this case, the K-th driving unit DUK may drive the K-th odd column pixels using the K-th column pixel data included in the half frame data HALF_FRAME_DATA. For example, the first driving unit DU1 may drive the first even column pixels P11E, P12E, . . . , P1NE using the first column pixel data CPD21B(B11~B1N) included in the half frame data HALF_FRAME_DATA, the second driving unit DU2 may drive the second odd column pixels P21O, P22O, . . . , P2NO using the second column pixel data CPD22B(B31~B3N) included in the half frame data HALF_FRAME_DATA, and the M-th driving unit DUM may drive the M-th odd column pixels PM1O, PM2O, . . . , PMNO using the M-th column pixel data CPD2MB(B(2M-1)1~B(2M-1)N) included in the half frame data HALF_FRAME_DATA.

In this case, the K-th even column pixels may maintain a previous status without being driven by the K-th driving unit DUK. For example, the first even column pixels P11E, P12E, . . . , P1NE, the second even column pixels P21E, P22E, . . . , P2NE, and the M-th even column pixels PM1E, PM2E, . . . , PMNE may maintain a previous status without being driven by the first driving unit DU1, the second driving unit DU2, and the M-th driving unit DUM, respectively.

Figure 9:
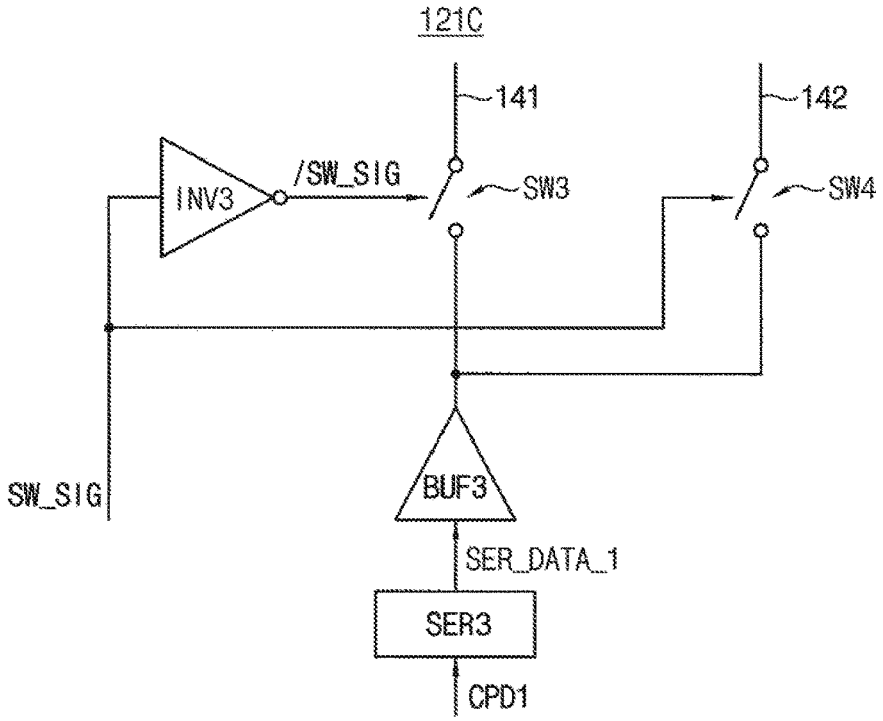
FIGS. 9 and 10 are circuit diagrams illustrating examples of a first driving unit included in the display device of FIG. 1.
Figure 10:
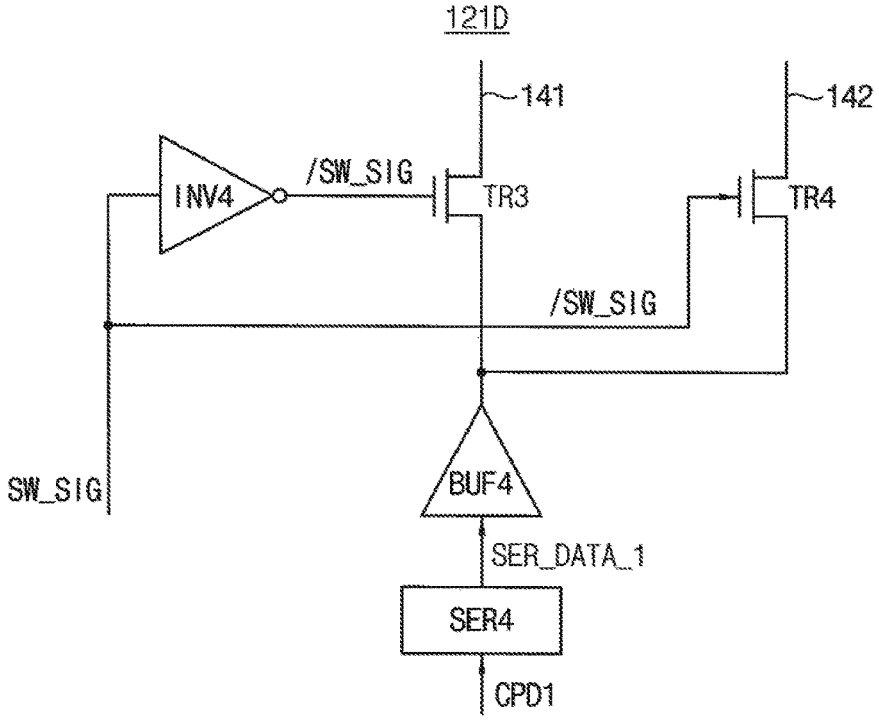

FIGS. 9 and 10 are circuit diagrams illustrating examples of a first driving unit included in the display device of FIG. 1.

Each of the second through M-th driving units DU2~DUM included in the display device 100 of FIG. 1 may have the same structure as first driving units 121C and 121D of FIGS. 9 and 10.

Referring to FIG. 9, the first driving unit 121C includes a third serializer SER3, a third inverter INV3, a third buffer BUF3, a third switch SW3, and a fourth switch SW4.

The third serializer SER3 receives the first column pixel data CPD1 included in the half frame data HALF_FRAME_DATA from the image processor 130, and serializes the first column pixel data CPD1 to generate a first serial data SER_DATA_1. For example, the first column pixel data CPD1 may correspond to the first column pixel data CPD11B(A21~A2N) in the case of FIG. 7, and correspond to the first column pixel data CPD21B(B11~B1N) in the case of FIG. 8.

The third inverter INV3 receives the switch signal SW_SIG, and inverts the switch signal SW_SIG to generate an inverted version of the switch signal/SW_SIG.

The third buffer BUF3 receives the first serial data SER_DATA_1, and outputs an amplified version of the first serial data SER_DATA_1.

The third switch SW3 is coupled between an output electrode of the third buffer BUF3 and the first odd column line 141. The third switch SW3 may be turned on in response to the inverted version of the switch signal/SW_SIG.

The fourth switch SW4 is coupled between the output electrode of the third buffer BUF3 and the first even column line 142. The fourth switch SW4 may be turned on in response to the switch signal SW_SIG.

When the switch signal SW_SIG is activated, the third switch SW3 may be turned off and the fourth switch SW4 may be turned on. Therefore, the third buffer BUF3 may consecutively drive the first even column pixels P11E, P12E, . . . , P1NE coupled to the first even column line 142 using the amplified version of the first serial data SER_DATA_1.

When the switch signal SW_SIG is deactivated, the third switch SW3 may be turned on and the fourth switch SW4 may be turned off. Therefore, the third buffer BUF3 may consecutively drive the first odd column pixels P11O, P12O, . . . , P1NO coupled to the first odd column line 141 using the amplified version of the first serial data SER_DATA_1.

Referring to FIG. 10, the first driving unit 121D includes a fourth serializer SER4, a fourth inverter INV4, a fourth buffer BUF4, a third NMOS transistor TR3, and a fourth NMOS transistor TR4.

The fourth serializer SER4 receives the first column pixel data CPD1 included in the half frame data HALF_FRAME_DATA from the image processor 130, and serializes the first column pixel data CPD1 to generate a first serial data SER_DATA_1. For example, the first column pixel data CPD1 may correspond to the first column pixel data CPD11B(A21~A2N) in the case of FIG. 7, and correspond to the first column pixel data CPD21B(B11~B1N) in the case of FIG. 8.

The fourth inverter INV4 receives the switch signal SW_SIG, and inverts the switch signal SW_SIG to generate an inverted version of the switch signal/SW_SIG.

The fourth buffer BUF4 receives the first serial data SER_DATA_1, and outputs an amplified version of the first serial data SER_DATA_1.

The third NMOS transistor TR3 is coupled between an output electrode of the fourth buffer BUF4 and the first odd column line 141. A gate of the third NMOS transistor TR3 receives the inverted version of the switch signal/SW_SIG.

The fourth NMOS transistor TR4 is coupled between the output electrode of the fourth buffer BUF4 and the first even column line 142. A gate of the fourth NMOS transistor TR4 receives the switch signal SW_SIG.

Although a structure of the first through M-th driving units DU1~DUM is described above with reference to FIGS. 9 and 10, example embodiments are not limited thereto. According to example embodiments the first through M-th driving units DU1~DUM may be implemented with other structures.

Figure 11:
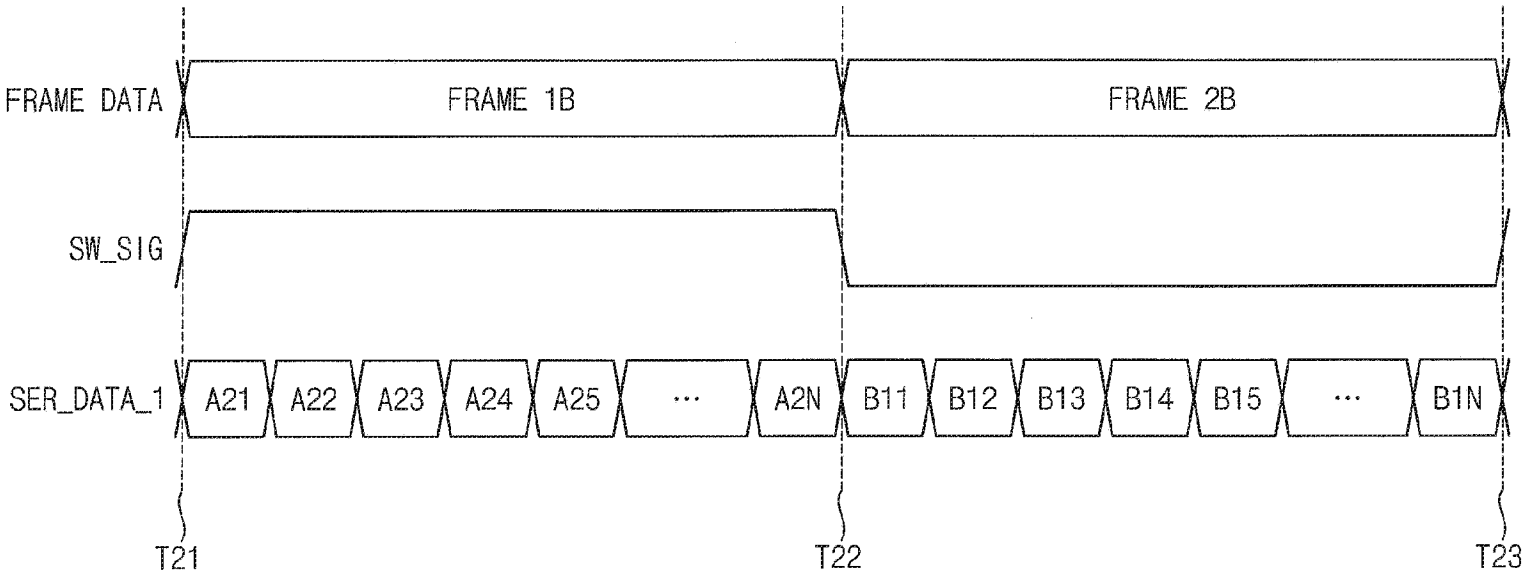
FIG. 11 is a timing diagram illustrating an operation of the first driving unit of FIG. 1.

FIG. 11 is a timing diagram illustrating an operation of the first driving unit of FIG. 1.

Referring to FIG. 11, a new frame period starts at a first time T21, and the first frame data FRAME 1B of FIG. 7 may be provided to the image processor 130 as the frame data FRAME_DATA at the first time T21. Therefore, the image processor 130 may activate the switch signal SW_SIG from the first time T21 to a second time T22. During the frame period from the first time T21 to the second time T22, the first driving unit DU1 may consecutively drive the first even column pixels P11E, P12E, . . . , P1NE coupled to the first even column line 142 using the first serial data SER_DATA_1 including the first column pixel data CPD11B(A21~A2N) of FIG. 7. During the frame period from the first time T21 to the second time T22, the first odd column pixels P11O, P12O, . . . , P1NO, the second odd column pixels P21O, P22O, . . . , P2NO, and the M-th odd column pixels PM1O, PM2O, . . . , PMNO may maintain a previous status without being driven by the first driving unit DU1, the second driving unit DU2, and the M-th driving unit DUM, respectively.

A next frame period starts at the second time T22, and the second frame data FRAME 2B of FIG. 8 may be provided to the image processor 130 as the frame data FRAME_DATA at the second time T22. Therefore, the image processor 130 may deactivate the switch signal SW_SIG from the second time T22 to a third time T23. During the frame period from the second time T22 to the third time T23, the first driving unit DU1 may consecutively drive the first odd column pixels P11O, P12O, . . . , P1NO coupled to the first odd column line 141 using the first serial data SER_DATA_1 including the first column pixel data CPD21B(B11~B1N) of FIG. 8. During the frame period from the second time T22 to the third time T23, the first even column pixels P11E, P12E, . . . , P1NE, the second even column pixels P21E, P22E, . . . , P2NE, and the M-th even column pixels PM1E, PM2E, . . . , PMNE may maintain a previous status without being driven by the first driving unit DU1, the second driving unit DU2, and the M-th driving unit DUM, respectively.

Figure 12:
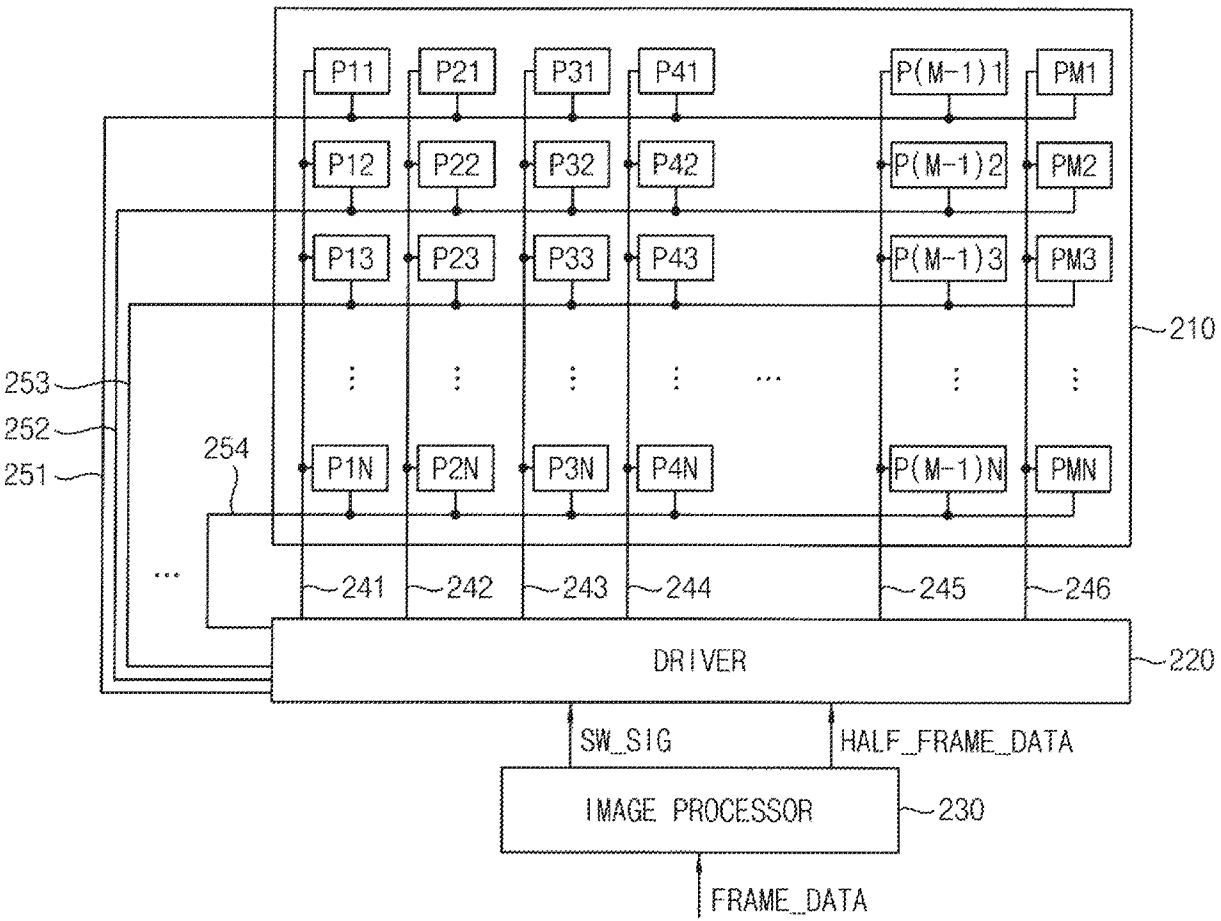
FIG. 12 is a block diagram illustrating a display device according to example embodiments.

FIG. 12 is a block diagram illustrating a display device according to example embodiments.

Referring to FIG. 12, a display device 200 includes a display panel 210, a driver 220, and an image processor 230.

The display panel 210 includes (1, 1)-th through (M, N)-th pixels P11~PMN coupled to a plurality of column lines 241~246 and a plurality of row lines 251~254 in a matrix form.

The image processor 230 generates a switch signal SW_SIG. The image processor 230 may invert a logic level of the switch signal SW_SIG at a change of frames. The image processor 230 may output one among (a, b)-th pixel data and (c, d)-th pixel data among (1, 1)-th through (M, N)-th pixel data included in a frame data FRAME_DATA as a half frame data HALF_FRAME_DATA based on the logic level of the switch signal SW_SIG. Here, M and N represent positive integers, a and c represent positive integers less than or equal to M, b and d represent positive integers less than or equal to N, a+b is an even number, and c+d is an odd number.

Based on the logic level of the switch signal SW_SIG, the driver 220 may drive the (a, b)-th pixels through the plurality of column lines 241~246 and a plurality of row lines 251~254 using the (a, b)-th pixel data included in the half frame data HALF_FRAME_DATA, or drive the (c, d)-th pixels through the plurality of column lines 241~246 and a plurality of row lines 251~254 using the (c, d)-th pixel data included in the half frame data HALF_FRAME_DATA.

Figure 13:
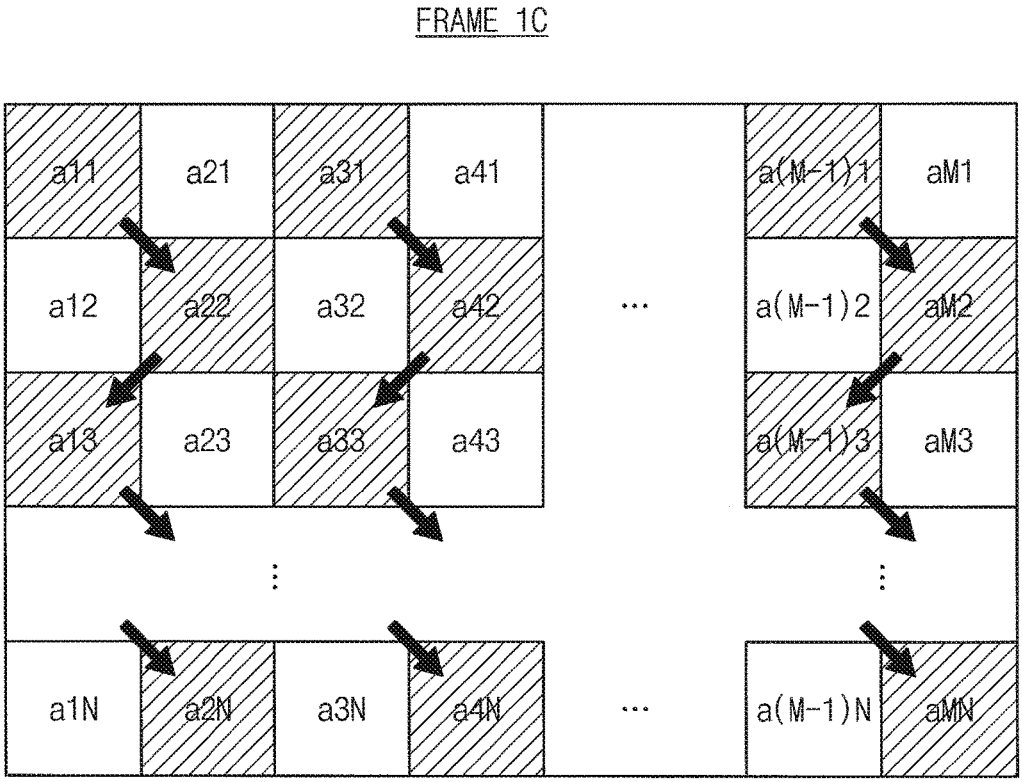
FIGS. 13 and 14 are diagrams illustrating a frame data provided to the display device of FIG. 12.
Figure 14:
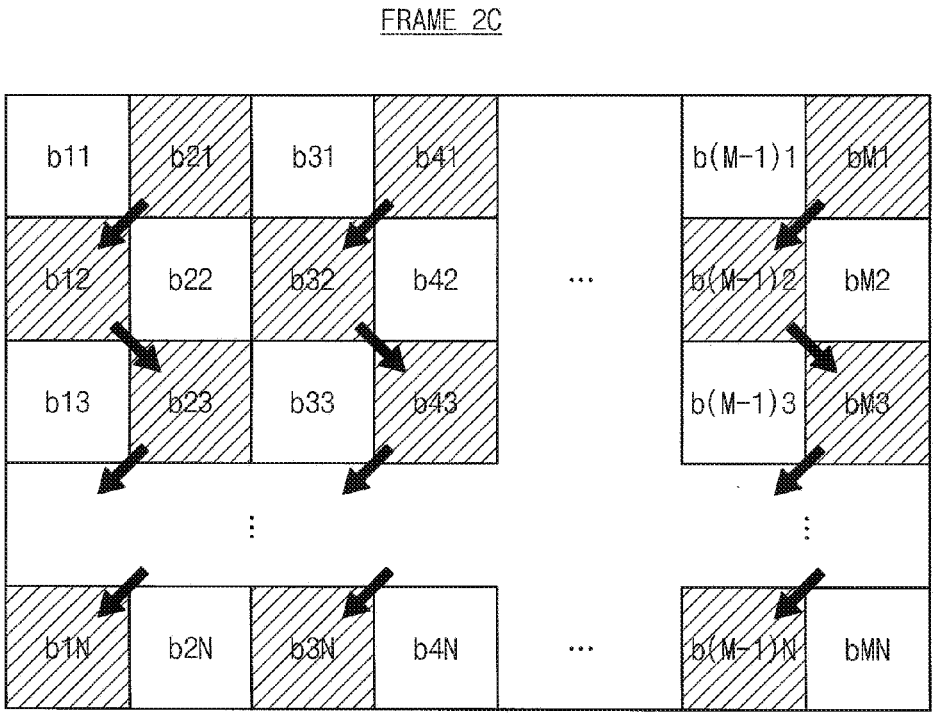

FIGS. 13 and 14 are diagrams illustrating a frame data provided to the display device of FIG. 12.

After a first frame data FRAME 1C of FIG. 13 is provided to the display device 200 of FIG. 12 as the frame data FRAME_DATA, a second frame data FRAME 2C of FIG. 14 may be provided to the display device 200 of FIG. 12 as the frame data FRAME_DATA.

In example embodiments, as illustrated in FIG. 13, when the switch signal SW_SIG is activated, the image processor 230 may output the (a, b)-th pixel data among the first frame data FRAME 1C as the half frame data HALF_FRAME_DATA, and the driver 220 may drive the (a, b)-th pixels using the half frame data HALF_FRAME_DATA.

For example, as illustrated in FIG. 13, the (a, b)-th pixel data includes the (1, 1)-th pixel data all, the (3, 1)-th pixel data a31, the (M-1, 1)-th pixel data a(M-1)1, the (2, 2)-th pixel data a22, the (4, 2)-th pixel data a42, the (M, 2)-th pixel data aM2, the (1, 3)-th pixel data a13, the (3, 3)-th pixel data a33, the (M-1, 3)-th pixel data a(M-1)3, the (2, N)-th pixel data a2N, the (4, N)-th pixel data a4N, and the (M, N)-th pixel data aMN of the first frame data FRAME 1C.

The driver 220 may consecutively drive the (1, 1)-th pixel P11, the (2, 2)-th pixel P22, the (1, 3)-th pixel P13, and the (2, N)-th pixel P2N using the (1, 1)-th pixel data all, the (2, 2)-th pixel data a22, the (1, 3)-th pixel data a13, and the (2, N)-th pixel data a2N. Similarly, the driver 220 may consecutively drive the (3, 1)-th pixel P31, the (4, 2)-th pixel P42, the (3, 3)-th pixel P33, and the (4, N)-th pixel P4N using the (3, 1)-th pixel data a31, the (4, 2)-th pixel data a42, the (3, 3)-th pixel data a33, and the (4, N)-th pixel data a4N. Similarly, the driver 220 may consecutively drive the (M-1, 1)-th pixel P(M-1)1, the (M, 2)-th pixel PM2, the (M-1, 3)-th pixel P(M-1)3, and the (M, N)-th pixel PMN using the (M-1, 1)-th pixel data a(M-1)1, the (M, 2)-th pixel data aM2, the (M-1, 3)-th pixel data a(M-1)3, and the (M, N)-th pixel data aMN.

In this case, the (c, d)-th pixels may maintain a previous status without being driven by the driver 220.

In example embodiments, as illustrated in FIG. 14, when the switch signal SW_SIG is deactivated, the image processor 230 may output the (c, d)-th pixel data among the second frame data FRAME 2C as the half frame data HALF_FRAME_DATA, and the driver 220 may drive the (c, d)-th pixels using the half frame data HALF_FRAME_DATA.

For example, as illustrated in FIG. 14, the (c, d)-th pixel data includes the (2, 1)-th pixel data b21, the (4, 1)-th pixel data b41, the (M, 1)-th pixel data bM1, the (1, 2)-th pixel data b12, the (3, 2)-th pixel data b32, the (M-1, 2)-th pixel data b(M-1)2, the (2, 3)-th pixel data b23, the (4, 3)-th pixel data b43, the (M, 3)-th pixel data bM3, the (1, N)-th pixel data b1N, the (3, N)-th pixel data b3N, and the (M-1, N)-th pixel data b(M-1)N of the second frame data FRAME 2C.

The driver 220 may consecutively drive the (2, 1)-th pixel P21, the (1, 2)-th pixel P12, the (2, 3)-th pixel P23, and the (1, N)-th pixel MN using the (2, 1)-th pixel data b21, the (1, 2)-th pixel data b12, the (2, 3)-th pixel data b23, and the (1, N)-th pixel data b1N. Similarly, the driver 220 may consecutively drive the (4, 1)-th pixel P41, the (3, 2)-th pixel P32, the (4, 3)-th pixel P43, and the (3, N)-th pixel P3N using the (4, 1)-th pixel data b41, the (3, 2)-th pixel data b32, the (4, 3)-th pixel data b43, and the (3, N)-th pixel data b3N. Similarly, the driver 220 may consecutively drive the (M, 1)-th pixel PM1, the (M-1, 2)-th pixel P(M-1)2, the (M, 3)-th pixel PM3, and the (M-1, N)-th pixel P(M-1)N using the (M, 1)-th pixel data bM1, the (M-1, 2)-th pixel data b(M-1)2, the (M, 3)-th pixel data bM3, and the (M-1, N)-th pixel data b(M-1)N.

In this case, the (a, b)-th pixels may maintain a previous status without being driven by the driver 220.

In example embodiments, when the switch signal SW_SIG is activated, the image processor 230 may output the (c, d)-th pixel data as the half frame data HALF_FRAME_DATA, and the driver 220 may drive the (c, d)-th pixels using the half frame data HALF_FRAME_DATA. When the switch signal SW_SIG is deactivated, the image processor 230 may output the (a, b)-th pixel data as the half frame data HALF_FRAME_DATA, and the driver 220 may drive the (a, b)-th pixels using the half frame data HALF_FRAME_DATA.

In this case, succeeding operations may be performed similar to the operations described above with reference to FIGS. 13 and 14.

Figure 15:
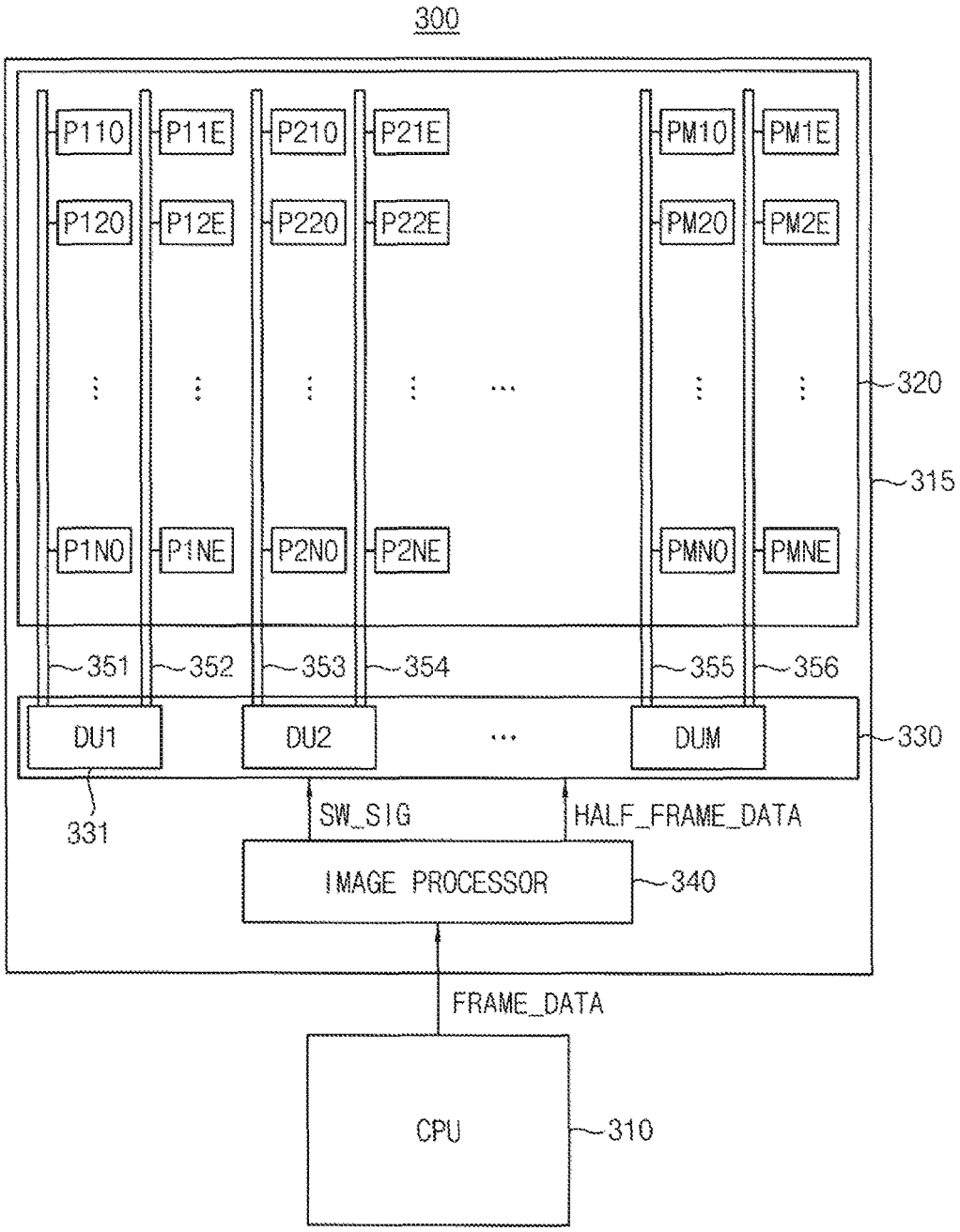
FIG. 15 is a block diagram illustrating a display system according to example embodiments.

FIG. 15 is a block diagram illustrating a display system according to example embodiments.

Referring to FIG. 15, a display system 300 includes a central processing unit CPU 310 and a display device 315.

The CPU 310 generates a frame data FRAME_DATA.

The display device 315 generates a switch signal SW_SIG. The display device 315 may invert a logic level of the switch signal SW_SIG at a change of frames. The display device 315 may select one among odd column pixel data and even column pixel data among first through (2M)-th column pixel data included in the frame data FRAME_DATA as a half frame data HALF_FRAME_DATA based on the logic level of the switch signal SW_SIG, and display the half frame data HALF_FRAME_DATA during one frame period. Here, M represents a positive integer.

The display device 315 includes a display panel 320, a driving circuit 330, and an image processor 340. For example, the display panel 320 includes first odd column pixels P11O, P12O, . . . , P1NO coupled to a first odd column line 351, second odd column pixels P21O, P22O, . . . , P2NO coupled to a second odd column line 353, and M-th odd column pixels PM1O, PM2O, . . . , PMNO coupled to an M-th odd column line 355. In addition, the display panel 110 includes a first even column pixels P11E, P12E, . . . , P1NE coupled to a first even column line 352, a second even column pixels P21E, P22E, . . . , P2NE coupled to a second even column line 354, and an M-th even column pixels PM1E, PM2E, . . . , PMNE coupled to an M-th even column line 356. For example, the first driving unit DU1 121 may drive the first odd column pixels P11O, P12O, . . . , P1NO through the first odd column line 141 using a first column pixel data included in the half frame data HALF_FRAME_DATA, or drive the first even column pixels P11E, P12E, . . . , P1NE through the first even column line 142 using the first column pixel data included in the half frame data HALF_FRAME_DATA, based on the logic level of the switch signal SW_SIG.

The driving circuit 330 includes first through M-th driving units DU1~DUM. Here, M represents a positive integer. For example, a first driving unit DU1 331 may drive the first odd column pixels P11O, P12O, . . . , P1NO through the first odd column line 351 using a first column pixel data included in the half frame data HALF_FRAME_DATA, or drive the first even column pixels P11E, P12E, . . . , P1NE through the first even column line 352 using the first column pixel data included in the half frame data HALF_FRAME_DATA, based on the logic level of the switch signal SW_SIG.

The display device 315 may be the same as the display device 100 of FIG. 1. A structure and an operation of the display device 100 are described above with reference to FIGS. 1 to 11. Therefore, detailed description about the display device 315 will be omitted.

Figure 16:
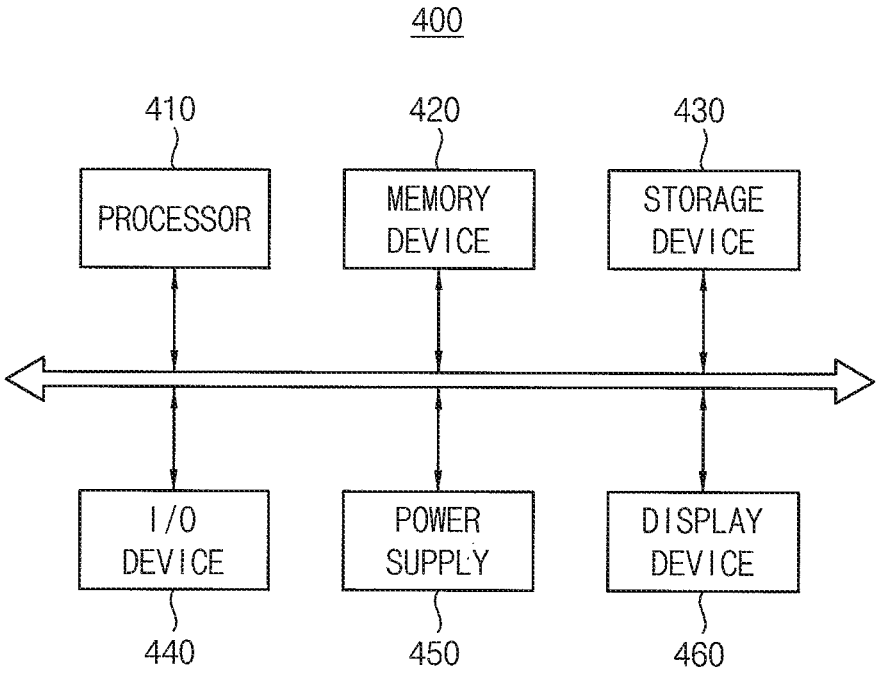
FIG. 16 is a block diagram illustrating an electronic device according to example embodiments.

FIG. 16 is a block diagram illustrating an electronic device according to example embodiments.

Referring to FIG. 16, an electronic device 400 includes a processor 410, a memory device 420, a storage device 430, an input/output device 440, a power supply 450, and a display device 460. The electronic device 400 may further include ports to communicate with a video card, a sound card, a memory card, a universal serial bus (USB) device, etc. The electronic device 400 may be implemented with a smart phone. However, example embodiments are not limited thereto.

The processor 410 may perform various computing functions, such as executing software for performing calculations or tasks. For example, the processor 410 may be a microprocessor or a central process unit. The processor 410 is connected to the memory device 420 and the storage device 430 via a bus such as an address bus, a control bus or a data bus, etc. The processor 410 may be connected to an extended bus, such as peripheral component interconnect (PCI) bus.

The memory device 420 may store data for an operation of the electronic device 400. The memory device 420 may include a dynamic random access memory (DRAM), a static random access memory (SRAM), or a non-volatile memory, such as an erasable programmable read-only memory (EPROM), an electrically erasable programmable read-only memory (EEPROM), a flash memory, etc.

The storage device 430 may include a non-volatile memory device such as a flash memory device, a solid state drive (SSD), etc.

The input/output device 440 may include at least one input device (e.g., a keyboard, keypad, a mouse, a touch screen, etc.) and/or at least one output device (e.g., a printer, a speaker, etc.).

The power supply 450 may supply an operational power.

The display device 460 may be connected to the processor 410 via the bus.

In example embodiments, the display device 460 may be implemented with the display device 100 of FIG. 1. In example embodiments, the processor 410 and the display device 460 may be implemented with the CPU 310 and the display device 315 of FIG. 15, respectively.

The electronic device 400 may be any electronic devices such as a digital camera, a mobile phone, a smart phone, a laptop computer, a portable multimedia player (PMP), a personal digital assistant (PDA), etc.

As is traditional in the field of the inventive concepts, example embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the example embodiments may be physically separated into two or more interacting and discrete blocks, units and/or modules without departing from the scope of the inventive concepts. Further, the blocks, units and/or modules of the example embodiments may be physically combined into more complex blocks, units and/or modules without departing from the scope of the inventive concepts.

The foregoing is illustrative of the present inventive concept and is not to be construed as limiting thereof. Although a few example embodiments have been described, those skilled in the art will readily appreciate that many modifications are possible in the example embodiments without materially departing from the novel teachings of the present inventive concept. Accordingly, all such modifications are intended to be included within the scope of the present inventive concept as defined in the claims. Therefore, it is to be understood that the foregoing is illustrative of example embodiments and is not to be construed as limited to the example embodiments disclosed, and that modifications to the disclosed example embodiments, as well as other example embodiments, are intended to be included within the scope of the appended claims.

What is claimed is:

1. A display device comprising:

an image processor configured to:

invert a logic level of a switch signal at a change of half frames; and output, based on the logic level of the switch signal, one among odd column pixel data and even column pixel data among first through (2M)-th column pixel data included in a frame data, as a half frame data, M being a positive integer;

a display panel comprising first through M-th odd column pixels coupled to first through M-th odd column lines, respectively, and first through M-th even column pixels coupled to first through M-th even column lines, respectively; and a driving circuit comprising first through M-th driving units comprising a K-th driving unit, the K-th driving unit being configured to drive, based on the logic level of the switch signal, one among K-th odd column pixels, among the first through M-th odd column pixels, through a K-th odd column line, among the first through M-th odd column lines, using a K-th column pixel data included in the half frame data, and K-th even column pixels, among the first through M-th even column pixels, through a K-th even column line, among the first through M-th even column lines, using the K-th column pixel data included in the half frame data, K being a positive integer less than or equal to M.

2. The display device of claim 1, wherein the image processor is further configured to:

in response to an activation of the logic level of the switch signal, output the odd column pixel data as the half frame data; and in response to a deactivation of the logic level of the switch signal, output the even column pixel data as the half frame data, and the K-th driving unit is further configured to:

in response to the activation of the logic level of the switch signal, drive the K-th odd column pixels through the K-th odd column line, using the odd column pixel data; and in response to the deactivation of the logic level of the switch signal, drive the K-th even column pixels through the K-th even column line, using the even column pixel data.

3. The display device of claim 2, wherein, the K-th even column pixels are configured to, in response to the activation of the logic level of the switch signal, maintain a previous status without being driven by the K-th driving unit, and the K-th odd column pixels are configured to, in response to the deactivation of the logic level of the switch signal, maintain the previous status without being driven by the K-th driving unit.

4. The display device of claim 2, wherein the K-th driving unit comprises:

a serializer configured to serialize the K-th column pixel data to generate a K-th serial data;

an inverter configured to invert the switch signal;

a buffer configured to receive and amplify the K-th serial data;

a first switch coupled between an output electrode of the buffer and the K-th odd column line, and configured to be turned on in response to the switch signal; and a second switch coupled between the output electrode of the buffer and the K-th even column line, and configured to be turned on in response to the inverted switch signal.

5. The display device of claim 4, wherein the first switch is further configured to be turned on, the second switch is further configured to be turned off, and the buffer is further configured to drive the K-th odd column pixels through the K-th odd column line, using the amplified K-th serial data, in response to the activation of the logic level of the switch signal, and the first switch is further configured to be turned off, the second switch is further configured to be turned on, and the buffer is further configured to drive the K-th even column pixels through the K-th even column line, using the amplified K-th serial data, in response to the deactivation of the logic level of the switch signal.

6. The display device of claim 4, wherein each of the first switch and the second switch comprises a transistor.

7. The display device of claim 1, wherein the image processor is further configured to:

in response to an activation of the logic level of the switch signal, output the even column pixel data as the half frame data; and in response to a deactivation of the logic level of the switch signal, output the odd column pixel data as the half frame data, and the K-th driving unit is further configured to:

in response to the activation of the logic level of the switch signal, drive the K-th even column pixels through the K-th even column line, using the even column pixel data; and in response to the deactivation of the logic level of the switch signal, drive the K-th odd column pixels through the K-th odd column line, using the odd column pixel data.

8. The display device of claim 7, wherein, the K-th odd column pixels are configured to, in response to the activation of the logic level of the switch signal, maintain a previous status without being driven by the K-th driving unit, and the K-th even column pixels are configured to, in response to the deactivation of the logic level of the switch signal, maintain the previous status without being driven by the K-th driving unit.

9. The display device of claim 7, wherein the K-th driving unit comprises:

a serializer configured to serialize the K-th column pixel data to generate a K-th serial data;

an inverter configured to invert the switch signal;

a buffer configured to receive and amplify the K-th serial data;

a first switch coupled between an output electrode of the buffer and the K-th odd column line, and configured to be turned on in response to the inverted switch signal; and a second switch coupled between the output electrode of the buffer and the K-th even column line, and configured to be turned on in response to the switch signal.

10. The display device of claim 9, wherein the first switch is further configured to be turned off, the second switch is further configured to be turned on, and the buffer is further configured to drive the K-th even column pixels through the K-th even column line, using the amplified K-th serial data, in response to the activation of the logic level of the switch signal, and the first switch is further configured to be turned on, the second switch is further configured to be turned off, and the buffer is further configured to drive the K-th odd column pixels through the K-th odd column line, using the amplified K-th serial data, in response to the deactivation of the logic level of the switch signal.

11. The display device of claim 9, wherein each of the first switch and the second switch comprises a transistor.

12. The display device of claim 1, wherein the K-th even column line is between the K-th odd column line and a (K+1)-th odd column line, among the first through M-th odd column lines.

13. A display device comprising:

an image processor configured to:

invert a logic level of a switch signal at a change of half frames; and output, based on the logic level of the switch signal, one among (a, b)-th pixel data and (c, d)-th pixel data among (1, 1)-th through (M, N)-th pixel data included in a frame data, as a half frame data, M and N being positive integers, a and c being positive integers less than or equal to M, b and d being positive integers less than or equal to N, a+b being an even number, and c+d being an odd number;

a display panel comprising (1, 1)-th to (M, N)-th pixels coupled to respective column lines and respective row lines in a matrix form; and a driver configured to drive, based on the logic level of the switch signal, one among (a, b)-th pixels, among the (1, 1)-th to (M, N)-th pixels, through the respective column lines and the respective row lines, using the (a, b)-th pixel data included in the half frame data, and (c, d)-th pixels, among the (1, 1)-th to (M, N)-th pixels, through the respective column lines and the respective row lines, using the (c, d)-th pixel data included in the half frame data.

14. The display device of claim 13, wherein the image processor is further configured to:

in response to an activation of the logic level of the switch signal, output the (a, b)-th pixel data as the half frame data; and in response to a deactivation of the logic level of the switch signal, output the (c, d)-th pixel data as the half frame data, and the driver is further configured to:

in response to the activation of the logic level of the switch signal, drive the (a, b)-th pixels through the respective column lines and the respective row lines, using the (a, b)-th pixel data; and in response to the deactivation of the logic level of the switch signal, drive the (c, d)-th pixels through the respective column lines and the respective row lines, using the (c, d)-th pixel data.

15. The display device of claim 14, wherein, the (c, d)-th pixels are configured to, in response to the activation of the logic level of the switch signal, maintain a previous status without being driven by the driver, and the (a, b)-th pixels are configured to, in response to the deactivation of the logic level of the switch signal, maintain the previous status without being driven by the driver.

16. The display device of claim 13, wherein the image processor is further configured to:

in response to an activation of the logic level of the switch signal, output the (c, d)-th pixel data as the half frame data; and in response to a deactivation of the logic level of the switch signal, output the (a, b)-th pixel data as the half frame data, and the driver is further configured to:

in response to the activation of the logic level of the switch signal, drive the (c, d)-th pixels through the respective column lines and the respective row lines, using the (c, d)-th pixel data; and in response to the deactivation of the logic level of the switch signal, drive the (a, b)-th pixels through the respective column lines and the respective row lines, using the (a, b)-th pixel data.

17. The display device of claim 16, wherein, the (a, b)-th pixels are configured to, in response to the activation of the logic level of the switch signal, maintain a previous status without being driven by the driver, and the (c, d)-th pixels are configured to, in response to the deactivation of the logic level of the switch signal, maintain the previous status without being driven by the driver.

18. A display device comprising:

an image processor configured to:

change a switch signal at a change of half frames;

output odd column pixel data among total column pixel data included in frame data, as a half frame data, based on a first logic level of the switch signal; and output even column pixel data among the total column pixel data, as the half frame data, based on a second logic level of the switch signal;

a display panel comprising odd column pixels respectively coupled to odd column lines, and even column pixels respectively coupled to even column lines; and a driving circuit comprising driving units, each of the driving units being configured to:

drive, based on the first logic level of the switch signal, a respective set of the odd column pixels through a respective one of the odd column lines, using the odd column pixel data included in the half frame data; and drive, based on the second logic level of the switch signal, a respective set of the even column pixels through a respective one of the even column lines, using the even column pixel data included in the half frame data.

19. The display device of claim 18, wherein the first logic level of the switch signal is a high logic level, and the second logic level of the switch signal is a low logic level.

20. The display device of claim 18, wherein the first logic level of the switch signal is a low logic level, and the second logic level of the switch signal is a high logic level.

* * * * *